United States Patent [19]

Buxmann et al.

[11] 4,250,950

[45] Feb. 17, 1981

[54] MOULD WITH ROUGHENED SURFACE FOR CASTING METALS

[75] Inventors: Kurt Buxmann; Martin Bolliger, both of Sierre; Ivan Gyöngyös, Männedorf, all of Switzerland

[73] Assignee: Swiss Aluminium Ltd., Chippis, Switzerland

[21] Appl. No.: 88,117

[22] Filed: Oct. 25, 1979

[30] Foreign Application Priority Data

Nov. 3, 1978 [CH] Switzerland ..... 11328/78
Dec. 28, 1978 [DE] Fed. Rep. of Germany ..... 2856472

[51] Int. Cl.[3] ..... B22D 11/06; B22D 7/06

[52] U.S. Cl. ..... 164/430; 164/47; 164/82; 164/122; 164/418; 164/432; 164/433; 249/141; 249/174

[58] Field of Search ..... 164/418, 428–433, 164/47, 82, 410, 122, 125; 249/133, 141, 174

[56] References Cited

U.S. PATENT DOCUMENTS

| | | | |
|---|---|---|---|
| 3,642,055 | 2/1972 | Nighman | 164/432 X |
| 4,088,295 | 5/1978 | Medovar et al. | 164/418 X |

FOREIGN PATENT DOCUMENTS

| | | | |
|---|---|---|---|
| 630095 | 3/1963 | Belgium | 164/431 |
| 1364717 | 5/1964 | France | 164/433 |
| 879437 | 10/1961 | United Kingdom | 164/418 |

*Primary Examiner*—Robert D. Baldwin
*Assistant Examiner*—Gus T. Hampilos
*Attorney, Agent, or Firm*—Bachman and LaPointe

[57] ABSTRACT

A mold for casting metals is provided with a roughened surface so that, on first contact of the mold with the melt, heat transfer is controlled in such a way that the melt comes into contact only with the peaks of the projections on the mold surface and an air gap is formed between the melt and the valleys on the surface. The pattern of roughness on the mold surface comprises a uniform arrangement of pyramidal or blunted-cone shaped projections. Neighboring projections are spaced a distance d of 0.05 to 1 mm apart and have a height h of $0.1d<h<d$. The pyramid or blunted con surfaces satisfy the condition of $0.05<f/d^2<0.5$. A process which does not involve deformation is preferred for producing the rough pattern, for example, a photochemical etching process. The molds are suitable for many casting processes, in particular for continuous D.C. ingot or strip casting with moving molds and caterpillar track type mold belts.

9 Claims, 2 Drawing Figures

MOULD WITH ROUGHENED SURFACE FOR CASTING METALS

BACKGROUND OF THE INVENTION

The present invention relates to a mold with a roughened surface which is used for casting metals, particularly aluminium and its alloys, by means of which mold the heat transfer, on first contact with the melt, is controlled in that the melt comes into contact only with the peaks on the roughened surface of the mold and an air gap is formed between the melt and the valleys or troughs in the roughened surface.

In continuous casting with moving molds the melt solidifies by coming directly into contact with the mold. Quality requirements make it necessary to control the transfer of heat accurately when the melt first makes contact with the mold. When the heat is extracted too quickly, as is the case with smoothly ground molds, there are often cold shuts in the cast product, which then leads to scrap. The transfer of a large amount of heat through the mold at the start also means high thermal stresses in the mold which can lead to cracks forming in the mold surface.

In the present state of the art there are two methods which are used to regulate the heat transfer between the melt and the mold. These are:

1. The surface of the mold is coated with a thermally insulating, protective layer.

2. The surface of the mold is roughened mechanically.

The use of insulating, protective layers often involves spraying a coat of lining material on the mold before casting commences. Ceramic layers which can be deposited by plasma spraying is another possibility. Experience has shown however that there are also disadvantages associated with the use of linings.

The lining must be deposited after each casting. It is especially important that the surface of the mold is coated uniformly, which depends of course on the skill of the operator. Nonuniform coating leads to areas in the cast strand or strip, where the rate of initial solidification differs. In most materials this leads to casting flaws which mostly appear in the form of surface porosity and surface cracks. Another problem is that there is always the danger of pick-up of particles from the coating material. For many products (e.g. foils) this leads to unacceptable contamination of the surface.

Experience has also shown that many aluminum alloys can be cast in continuously moving molds only if the initial solidification is sufficiently fast that the cell size at the surface of the cast strip is 10–20 μm. The normal coatings however produce milder solidification conditions which then lead to surface flaws—surface porosity in particular.

Permanent ceramic layers have the disadvantage—in view of the high coating costs—that they exhibit only limited service lives. It is also difficult using this method of coating to achieve an initial solidification rate which is sufficiently fast for casting alloys.

In the case of a mechanically roughened mold the heat transfer is regulated by creating a suitably rough surface. When the melt comes into contact with a mold surface which, for example has been roughened by shot peening with steel balls then, if the metallostatic head is not too high, it comes into contact only with the peaks on the roughened surface, while an air cushion forms between the melt and the valleys on the roughened surface.

By appropriate dimensioning of the relative contact surface $$K = \frac{\sum_{i=1}^{n} F_i}{F_o}$$

where $F_i$ = the contact surface of a peak on the surface $F_o$ = the total mold surface area n = the number of peaks on the surface and by controlling the depth of roughness and the average spacing of neighboring peaks, the heat transfer through the mold can be regulated.

In the present state of the art there are two methods for mechanically roughening continuously moving molds:

(a) Grooves are created in the surface by means of chip forming processes (milling, planing). This method however exhibits various disadvantages. Because the demand for uniformity of heat transfer through the molds surface is very high, the demand for uniformity in the grooves is also very high. Modern machine tools can satisfy these requirements only for grooves spaced at about 1 mm or more apart. When the grooving is to be finer it is difficult to maintain uniform depth and uniform contact surface area. Furthermore, the machining costs increase markedly with increasing fineness of the grooves. Also, the surface to be machined in a continuous casting unit with moving molds is very large indeed—in a unit with moving, caterpillar track type molds, where the casting width is 2 m and the length 3 m, the mold surface area is about 30 $m^2$.

Coarse grooving, i.e. a groove spacing of >0.5 mm, leads to cracks, especially when casting wide strip, as too deep penetration of the metal in the valleys of the grooves results in rubbing between the solidified melt and the mold, to such an extent that the shrinkage on solidification is hindered.

(b) By striking the mold with hard particles—steel balls in particular—the surface is indented. This method leads to a uniform reduction in heat transfer which, at a suitable metallostatic pressure, permits the casting also of highly alloyed alloys (e.g. AlMg 4.5) with moving molds, in particular if the mold is made of copper. Practical experience has however revealed another disadvantage of this process which is described in the following:

During long production runs, it is unavoidable that impurities gather in the recesses formed by peening or otherwise impacting, and these decompose to produce gases when heated. These impurities include organic substances, hydroxides and various salts which contain water of crystallization. If, on casting, the metal comes into contact with such a contaminated area, then gas is produced. At high casting speeds in particular this gas is trapped between the melt and the mould as, because of the special feature of the roughening (craters adjacent to each other but separated by ridges) the flow of the gas parallel to the mould surface is greatly hindered as soon as the melt touches the surface. Bubbles of gas trapped between the mould and the solidifying metal, however, lead to flaws in the cast strip, which generally result in the strip being scrapped. It has also been found that the removal of these impurities by the various cleaning methods—taking into account the safety measures required in production—does not provide a suitable remedy.

SUMMARY OF THE INVENTION

It is therefore an object of the present invention to develop a mould with a roughened surface for use in the casting of metal, whereby the said surface provides the requisite uniform, and exact reduction in heat transfer between the melt and the mould, at the same time avoiding flaws in the surface of the cast product which are caused by gas trapped between the melt and the mould.

DETAILED DESCRIPTION

Figure 1:
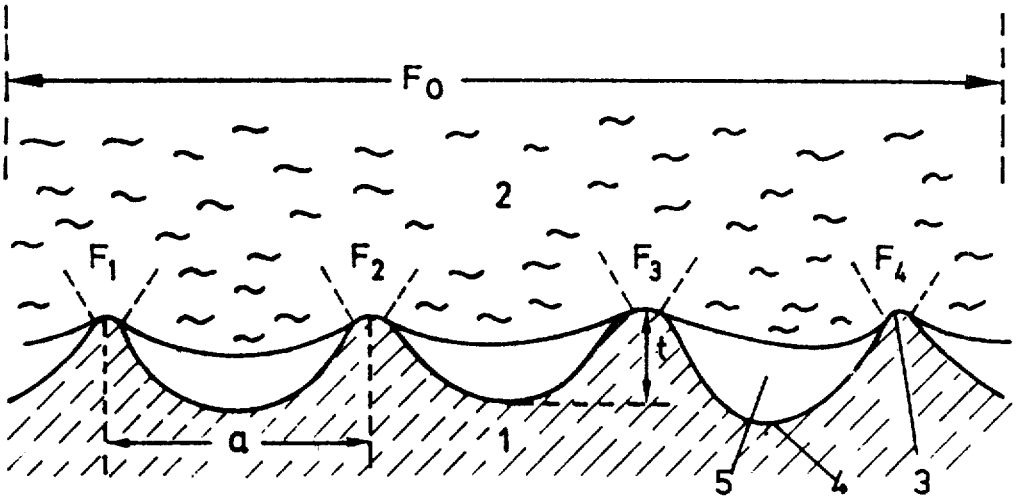
FIG. 1 Is a cross section through a part of a mold, the surface of which has been roughened for example by shot peening with steel balls.

The foregoing object is achieved by way of the present invention in that the valleys in the roughened surface are interconnected in such a way that gases produced in the valleys when the melt comes in contact with the mold, can escape without hindrance parallel to the mold surface, with the result that the melt is not raised from the mold surface as a result of excessively high gas pressure in that region.

An advantageous version of the object of the present invention is such that the mold surface features a roughened surface comprising a regular pattern of pyramidal or bluntcone projections.

When molten metal flows into this mold surface, then it comes into contact only with the surfaces f of the projections lying parallel to the surface of the mold. Consequently, the heat transfer during the initial stages of solidification can be chosen via the equation $$\alpha = f/d^2$$

The distance d between neighboring projection is defined here as the distance between the centers of the surfaces f in question.

A specially advantageous embodiment of the in such that $$0.05 < \alpha < 0.5, \text{ preferably } 0.1 < \alpha < 0.25$$

where the distance d equals 0.05 to 1 mm, preferably 0.2–0.5 mm. It has also been found advantageous to choose the height h of the the surface f and the plane represented by the lowest point in the valleys such that this height h lies within the limits:

$$0.1\ d < h < d, \text{ preferably } 0.15\ d < h < 0.4\ d$$

Extensive production trials with various aluminum alloys on a casting unit with moving, caterpillar track type molds have shown that using molds with surfaces roughened in this manner avoids the entrapment of gases and therefore allows top quality cast strip to be produced.

The improvement in the quality of the cast strip by using the molds in accordance with the present invention can be explained as follows. The gas which forms when the melt first comes into contact with the mold surface is able to flow freely in the connecting channels between the projections and is therefore able to escape.

There are special methods which are suitable for producing the necessary roughness pattern; these start from a smooth mold surface and do not involve any mechanical deformation of the mold surface. Preferred, is the etching of the requisite patterns into the mold surface.

It has been found particularly advantageous to produce an exactly defined roughness pattern by etching via photochemical etching processes, such as are used in the manufacture of printing rolls for the textile industry or for printed circuits in the electronic industry.

Trials with various aluminum alloys on a casting unit with moving, caterpillar-track type molds have shown that photochemical etching methods for producing a defined roughness pattern is to be preferred over mechanical methods, in particular when the molds are made of copper. Mechanically roughened copper surfaces always feature a certain amount of surface deformation. Experience shows that these are more susceptible to corrosion, and hydrogen and oxygen embrittlement. Also, mechanically roughened surfaces exhibit creep characteristics which can have an adverse effect on the geomtery of the moving mold. All these negative effects are not observed with the surface which has been photochemically roughened and is absolutely free of deformation.

Furthermore, trials have shown that photochemically roughened mold surfaces—for reasons similar to those in casting with moving molds—also lead to a considerable improvement in surface quality of the casting product when casting into chill molds and in continuous D.C. casting with molds where there is sliding contact between the metal being cast and the mold wall. This improvement means lower finishing costs.

In FIG. 1 the melt (2) is in contact with a mold surface (1) which has been roughened for example by shot peening with steel balls. The melt therefore comes into contact only with the areas around the tips (3) projecting upwards, and there is a cushion of air (5) between the melt (2) and the valleys (4) on the surface.

By appropriately dimensioning the relative contact surface area i.e. here, the ratio of the sum of the surface F, to $F_4$, to the total surface area $F_o$, and by selecting the depth of roughness t and the average distance a between neighboring peaks, the heat transfer between the melt and the mold can be regulated.

The section of the mold with a surface in accordance with the present invention features pyramidal shaped projections (6). These projections are characterized by a height h and a surface f lying parallel to the surface of the mold. Neighboring projections are spaced a distance d apart.

Figure 2:
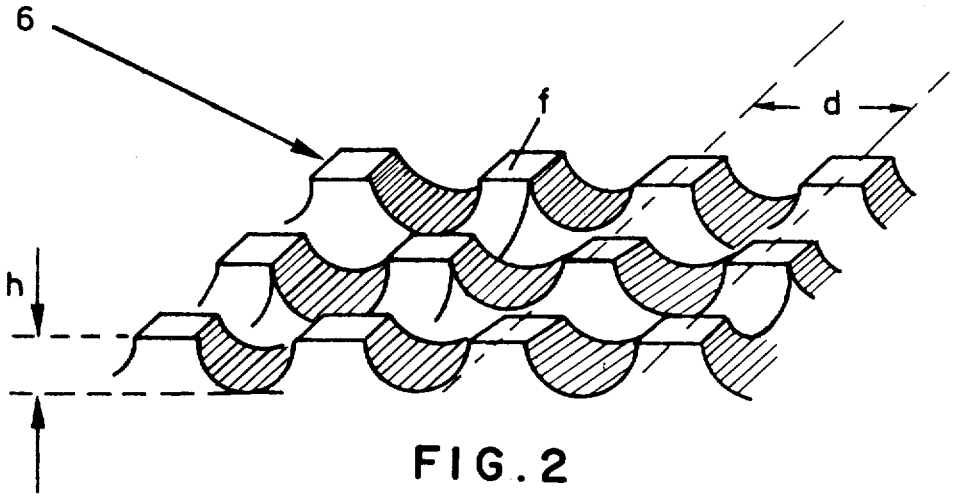
FIG. 2 Is a perspective view of a section of the surface of a mold in accordance with the invention.

From FIG. 2 it is clear that such a uniform pattern of roughness allows exact and reproducible control of the heat transfer between the melt and the mold, while at the same time the interconnecting system of channels between the individual projections ensures unhindered escape of the gases formed.

What claim is claimed:

1. A casting system for casting molten metal into a mold comprising a source of molten metal and a casting mold, said casting mold having a roughened surface comprising a uniform array of projections in the shape of a frustum of a pyramid such that said molten metal on initial contact with said mold contacts only top surfaces of said array of frustums which constitute high points of said roughened surface thereby forming an air gap between said molten metal and low points of said roughened mold surface wherein said low points of said roughened mold surface are interconnected so that gases in said air gap escape therefrom parallel to said mold surface thereby preventing the melt from rising from said mold surface wherein said projections are spaced apart a distance d of about 0.05 mm to 1 mm and the area of the top surface f of said projections is about $0.05\ d^2 < f < 0.5\ d^2$.

2. A casting system according to claim 1 wherein said projections are spaced apart a distance d of about 0.2 mm to 0.5 mm.

3. A casting system according to claim 2 wherein said projections are of a height h equal to about $0.1\ d < h < d$.

4. A casting system according to claim 3 wherein the area of the top surface f of said projections is about $0.1\ d^2 < f < 0.25\ d^2$.

5. A casting machine according to claim 3 wherein said projections are of a height h equal to about $0.15\ d < h < 0.4\ d$.

6. A casting system according to claim 1 wherein said casting system is a continuous casting system.

7. A casting system according to claim 6 wherein said continuous casting system comprises moving molds.

8. A casting system according to claim 7 wherein said moving molds are caterpillar track type belts.

9. A casting system according to claim 6 wherein there is sliding contact between said mold and said molten metal.

* * * * *